United States Patent [19]

Wyslotsky

[11] 4,268,530

[45] May 19, 1981

[54] PACKAGE FOR SLICED COMESTIBLE

[76] Inventor: Ihor Wyslotsky, 5328 W. 123rd Pl., Alsip, Ill. 60658

[21] Appl. No.: 81,647

[22] Filed: Oct. 4, 1979

[51] Int. Cl.[3] ..... B65D 85/72

[52] U.S. Cl. ..... 426/121; 206/45.14; 206/45.19; 426/124; 426/129; 426/396

[58] Field of Search ..... 206/462, 461, 45.14, 206/45.19, 45.33; 426/121, 124, 129, 412, 396

[56] References Cited

U.S. PATENT DOCUMENTS

| | | | |
|---|---|---|---|
| 3,026,209 | 3/1962 | Niblach | 426/124 |
| 3,054,681 | 9/1962 | Nelson | 426/126 |
| 3,155,303 | 11/1964 | Fenkel | 426/124 |
| 3,229,810 | 1/1966 | Doller | 206/45.34 |
| 3,597,238 | 8/1971 | Scharre | 426/121 |
| 3,700,096 | 12/1972 | Reifers | 206/45.33 |
| 3,868,014 | 2/1975 | Clarke | 206/45.19 |
| 3,978,260 | 8/1976 | Dobbins | 206/45.33 |
| 4,003,184 | 1/1977 | Shin | 426/121 |
| 4,029,822 | 6/1977 | Comer | 426/129 |

*Primary Examiner*—Herbert F. Ross
*Attorney, Agent, or Firm*—Robert M. Ward

[57] ABSTRACT

An improved package for containing a slab of sliced comestible product disposed in overlapping array, the package including a backing board having rounded and upwardly disposed corners with a smooth radius and lateral edges all of which are covered by the overlapping array of sliced comestible, and a film of transparent flexible material snugly enclosing the backing board and the overlapping array of sliced comestible product with the overlapping array of sliced comestible product interveningly cooperating with the lateral edges and rounded corners of the backing board to prevent puncturing of the film by the lateral edges and upwardly extending rounded corners of the backing board.

8 Claims, 3 Drawing Figures

PACKAGE FOR SLICED COMESTIBLE

BACKGROUND OF THE INVENTION

This invention relates to packaging for a sliced comestible, such as for example, bacon, and more particularly, to an improved package incorporating a polymeric backing board having rounded upwardly disposed corners to be covered by the sliced comestible in order that puncture of the film package enclosing material is prevented.

In the prior art, a number of backing materials have been proposed and utilized for a sliced comestible product, such as cheese or sliced meats, including bacon. In general, a soft and deformable material such as paper has been required, because of the problem of the backing material puncturing the film package enclosing material. Paper, however, has the disadvantage of lack of resistance to moisture, and over time presents a sticky and greasy surface appearance, which may be detrimental to the scale of the packaged product. Moreover, absorption of moisture by the paper backing material of the prior art may further tend to complicate the weight control process.

In order to alleviate the difficulties associated with paper backing sheets, a backing material of polymeric material has been proposed. However, the use of such materials as plastics for backing materials has in general been unsatisfactory, due to the tendency of the lateral edges and the corners of such plastic backing sheets to puncture the enclosing film, and thereby to reduce materially the shelf life of the contents of the package. Although this problem of tendency to puncture may be reduced by the use of heavier gauge enclosing film material, such a usage is costly and wasteful.

One attempt to solve the problems associated with the use of plastic backing sheets has been to extend such enclosing film material a substantial distance beyond the periphery of the backing board material. However, the extending of the film material a substantial distance beyond the periphery of the backing board is wasteful of the film material. Moreover, this technique does not address the fundamental cause of the problem, which is the puncturing during handling of a vacuumized package wherein atmospheric pressure forces the relatively thin enclosing film material against the sharp cut edges of the plastic backing board.

SUMMARY OF THE INVENTION

The above difficulties associated with the prior art may be materially alleviated by use of the present invention. In the present invention, the paper board is eliminated as a backing material and a semi-rigid plastic material is instead utilized for supporting the slices of the comestible product. The backing board is of a generally rectangular and planar shape and has rounded corners having a smooth radius, which rounded corners are angled upwardly. The sliced comestible product is overlayed on the backing board to cover the upwardly extending rounded corners and the lateral edges. The upwardly extending rounded corners are thus imbedded in the sliced material. A film of substantially transparent flexible material is disposed tightly around and snugly encloses the backing board and the overlapping array of sliced comestible product borne thereon wherein the flexible material contacts only the smooth radius of the rounded corners thereby to reduce greatly the probability of damage. Thus, the overlapping array of sliced comestible product interveningly cooperates with the lateral edges and the edges of the rounded, upwardly angling and extended corners of the backing board to shield and cushion such edges from the film, thereby to provide a package which is substantially snug to the dimensions of the overlapping array of sliced comestible product and also thereby to eliminate puncturing of the enclosing film.

This and other embodiments of the improved package of the present invention and methods of producing the same will be more completely understood from the following detailed description which is given in conjunction with the accompanying drawings.

DETAILED DESCRIPTION OF PREFERRED EMBODIMENTS

Figure 1:
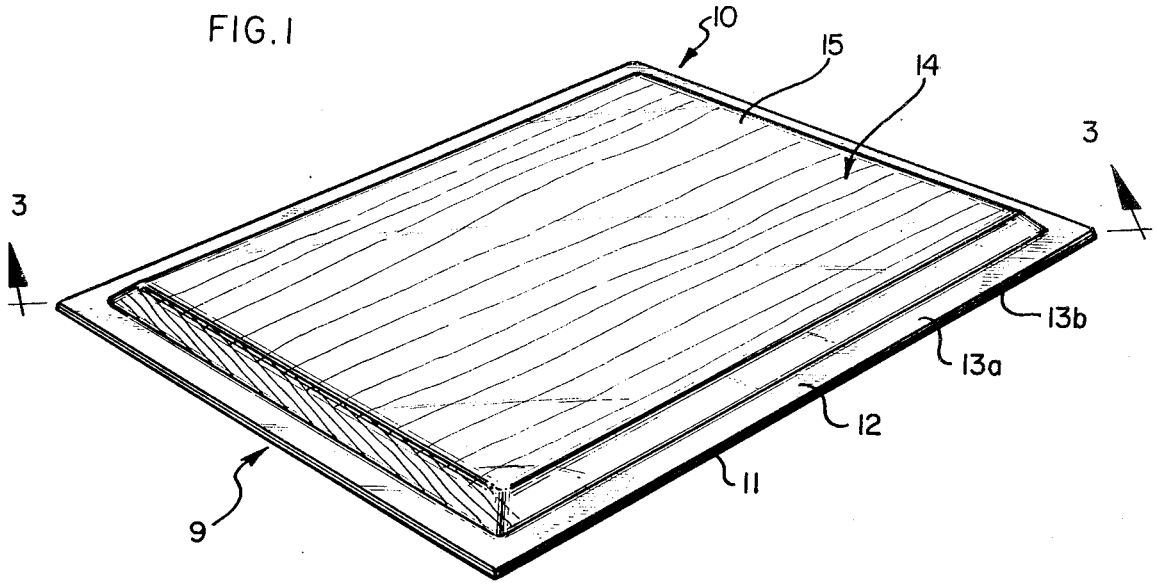
FIG. 1 is a perspective view of the package of the present invention as viewed from the top, showing the enclosing film and the overlapping array of sliced comestible product which covers and incrusts the edges and the upwardly extending rounded corners of the backing board, which cannot be seen in this Fig., as it is smaller in dimension than the overlapping array of sliced comestible product.

The package of the present invention is directed to packages for containing a slab of sliced comestible product, wherein slices are preferably disposed in overlapping array, to thereby display a portion of each face of each slice. The package comprises a backing board which is formed from a semi-rigid material for supporting the slices of the comestible product. The backing board is generally preferably rectangular and planar in shape and has rounded corners with a smooth radius. The rounded corners are angled upwardly and extend towards and incrust the supported sliced comestible product when the package is in assembled configuration, thereby preferably to imbed the sliced comestible product into the upwardly extending and rounded corners. The backing board thus preferably has one dimension which is less than the longitudinal dimension of the slab of sliced comestible product, and a second dimension transverse to the first dimension which is less than the width of the overlapping array of sliced commestible product. The result is that the sliced comestible product preferably covers the upwardly angled and extending portion of the rounded corners of the backing board. In certain alternative embodiments, a comestible product may be disposed within the backing board dimensions where it extends a substantial distance upwardly and above the height of the rounded corners. This disposition presents only the smooth radius of such corners to the enclosing film material.

A film of substantially transparent and flexible material is disposed tightly around and snugly enclosing the backing board and the overlapping array of sliced comestible product borne thereon. The overlapping array of imbedded sliced comestible product interveningly cooperates with the lateral edges and the smooth radius of the rounded upwardly angling and extending corners of the backing board to shield and cushion these edges from the film. The result is to permit the film to substantially conform to the contours of the overlapping array of sliced comestible product, to conserve on the amount of film used within the package, but at the same time to prevent any edge of the backing board, whether lateral edge or edge of the upwardly extending rounded corners, from piercing and puncturing the film material as may otherwise occur during mechanical and/or manual handling.

The film utilized in the package of the present invention may preferably in some embodiments be formed in separate bottom and top portions. Such bottom and top portions extend beyond the edges of the backing board and are sealed together at a distance laterally disposed from the backing board edges. In further alternative embodiments, the package is evacuated of air to permit such snug enclosing of the backing board and comestible product and to extend substantially the shelf life of the contents of the package. The film used in the improved package of the present invention may have a portion thereof bearing visual indicia.

The backing board of the present invention is preferably formed from a transparent material to permit observation of the underside of the overlapping array of sliced comestible product, which renders the packaging more attractive to the consumer, at least partially because such package transparency, top and bottom, provides a greater confidence in the quality, freshness and wholesomeness of the packaged comestible. The use of plastic material for the transparent backing board has found substantial utility wherein the slab of sliced comestible product comprises bacon, thereby permitting ready observation of the bottom surface of the sliced bacon which is rarely visible in prior art packaging, while at the same time preventing any weight loss of the packaged contents, unattractive sogginess and/or deformation of the backing board material, as have been present with the prior art paper backing board material.

The improved package of the present invention may be formed in preferred embodiments by the applicant's novel method for producing such an improved package. In such method of the present invention, a backing board formed from a sheet of planar material is provided. The planar sheet is cut into a generally rectangular shape with rounded corners having a smooth radius, such as by die cutting or other means. The rounded corners are permanently deformed, such as by heat deformation or other means, to project upwardly. In alternative perferred embodiments, the planar sheet may be molded into the generally rectangular shape with upwardly extending rounded corners.

Next, the comestible product to be enclosed in the package is sliced, and the sliced comestible product is disposed into an overlapping array, whereby a portion of each slice is exposed for observation. The resultant overlapping array of sliced comestible product is placed onto the backing board to cover the lateral edges and to incrust the edges of the upwardly extending rounded corners of the backing board. Finally, the backing board and sliced comestible product borne thereon are tightly enclosed within a formfitting transparent film material. In alternative preferred embodiments of the method of the present invention, the tightly enclosing film material may be provided in separate bottom and top portions and then sealed together at a distance from the lateral edges and from the edges of the upwardly extending corners of the backing board. In some preferred embodiments, the air is evacuated from the package prior to sealing of the package. In yet further alternative preferred embodiments, a portion of either the top or bottom or both of the enclosing film material may be imprinted with visual indicia prior to the enclosing use thereof.

Referring now to the drawing, and to FIG. 1 in particular, the improved package of the present invention generally comprises an enclosing film generally 10 which preferably includes a bottom portion 11 and a top portion 12 for surrounding and enclosing the package. Bottom portion 11 and top portion 12 are sealed together around their respective outer peripheries 13*a*, 13*b*. The material to be enclosed is a slab of sliced comestible product 14 wherein the slices are disposed in an overlapping array to display a portion of each slice 15. Based on federal regulations for bacon, at least seventy percent (70%) and preferably all of the face of the representative slice is displayed for visual inspection by the purchaser. As the slab of sliced comestible product is larger in dimensions than the backing board, such backing board cannot be seen in FIG. 1.

Figure 2:
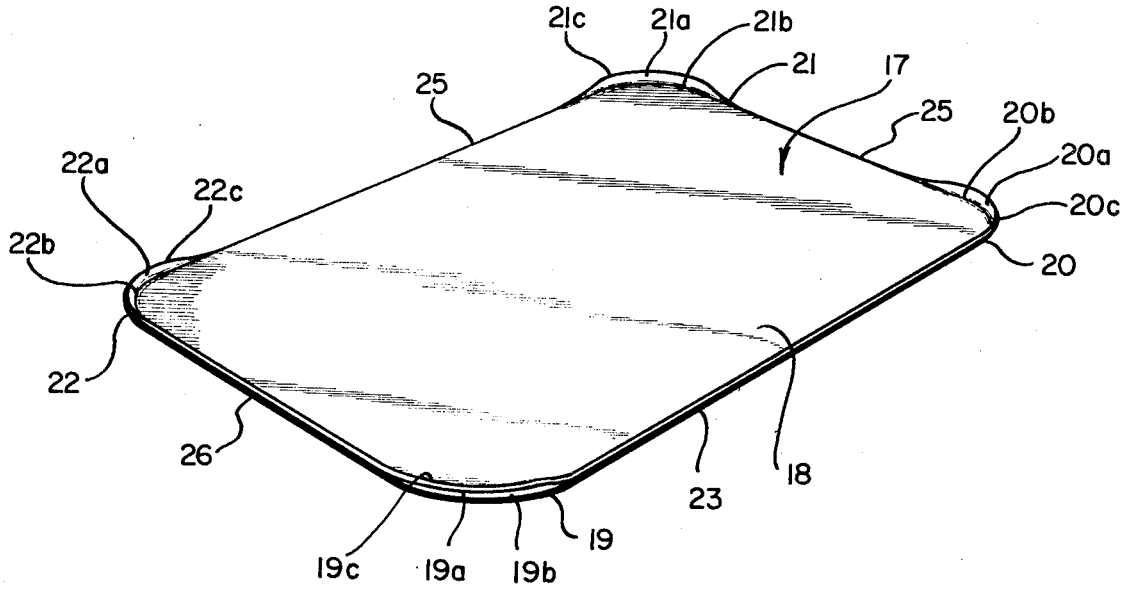
FIG. 2 is an upper perspective view of the backing board as used in the package of the present invention and shows the generally rectangular and planar shape of the backing board with its rounded corners having a smooth radius, which corners are angled upwardly and extend upwardly to be covered by the overlapping array of sliced comestible product as shown in FIG. 1.

Referring now to FIG. 2, the backing board generally 17 is shown. The backing board 17 is formed from a semi-rigid material, such as a plastic, and has a generally rectangular central body portion 18. The corners 19, 20, 21 and 22 of backing board 17 are of a generally rounded or other configuration with the absence of any substantially pointed edge. Each rounded corner 19, 20, 21 and 22 has an upwardly extending portion 19*a*, 20*a*, 21*a* and 22*a* including a smooth radius 19*b*, 20*b*, 21*b* and 22*b*, and a terminal corner edge 19*c*, 20*c*, 21*c* and 22*c*. Extending between such rounded upwardly extending portions 19*a*, 20*a*, 21*a* and 22*a* are the lateral edges 23, 24, 25 and 26 of backing board 17. In preferred embodiments, such lateral edges 23, 24, 25 and 26 may be rolled and/or rounded, such as by heat deformation and/or by rolled molding. However, inasmuch as lateral edges 23, 24, 25 and 26, as well as upwardly extending portions 19*a*, 20*a*, 21*a* and 22*a*, are to be overlayed by the sliced comestible product 14, there is no absolute requirement for providing smooth edges.

Figure 3:
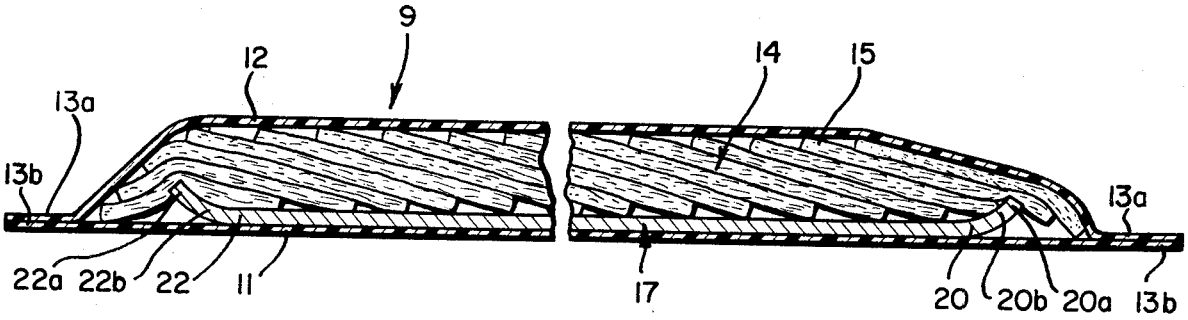
FIG. 3 is a cross-sectional view, slightly enlarged, taken along line 3—3 of FIG. 1, showing separate bottom and top portions of the film sealed at a distance laterally disposed from the upwardly extending rounded corners of the backing board, which backing board corners are covered and incrusted with the sliced product, such as bacon, thereby to shield and cushion the edges of the backing board from the film, which permits the film to substantially conform to the contours of the overlapping array of sliced comestible product without being punctured by any exposed edge surface of the backing board.

Referring now to FIG. 3, which is a cross-sectional view showing the configuration of the elements of the improved package of the present invention, slices of comestible product 15 are shown in overlapping configuration, wherein a portion of each slice is displayed. The sliced product 15 is borne on the centrally disposed body portion 18 and is imbedded on the upwardly extending edges. Rounded corners 20*a* and 22*a* are shown to be covered by slices 15 in FIG. 3. Backing board 17 and the borne and imbedded sliced product 15 are enclosed by means of bottom and top portions 11 and 12 of the film 10 and sealed together at their respective peripheral portions 13*a*, 13*b*. As shown most clearly in FIG. 3, the overlapping array of sliced comestible product 15 interveningly cooperates with the imbedded, rounded, upwardly-angled and extending corners 20*a* and 22*a* of backing board 17 to shield and cushion rounded corners 20*a* and 22*a* from top film portion 12, to permit film 10 to substantially conform to the contours of the overlapping array of slices 15 without being punctured by the edges of the rounded corners 20*a* and 22*a*.

Although preferred embodiments of the package and method of the present invention have been shown and described herein in detail, it is readily apparent that many changes and modifications may be made in the size, shape, detail and arrangement of the elements of the invention, all of which are included within the scope of the appended claims.

What is claimed is:

1. An improved package for containing a slab of a sliced comestible product with the slices disposed in an overlapping array to display a portion of each slice, said package comprising:

a backing board formed from a semi-rigid material for supporting slices of the comestible product, said backing board being generally rectangular and planar in shape and having rounded corners with a smooth radius, said rounded corners being angled upwardly and extending towards and embedded in the supported sliced comestible product when in assembled configuration, said backing board having one dimension which is less than the longitudinal dimension of the slab of sliced comestible product and a second dimension transverse to said first dimension which is less than the width of the overlapping array of sliced comestible product thereby overlapping and embedding said rounded, upwardly angled and extending corners of said backing board; and an enveloping film of substantially transparent flexible sheet material disposed tightly around and snugly enclosing said backing board and the overlapping array of sliced comestible product borne thereon, with the overlapping array of sliced comestible interveningly cooperating with the edges of said rounded, upwardly-angled and extending corners of said backing board to shield and cushion said edges from said film, thereby to permit said film to substantially conform to the contours of the overlapping array of sliced comestible product without being punctured by said edges of said upwardly-angled and extending corners of said backing board.

2. The package of claim 1 wherein said film is formed in separate bottom and top portions.

3. The package of claim 2 wherein said bottom and top portions of said film extend beyond the edges of said backing board and are sealed together laterally disposed from said backing board edges.

4. The package of claim 1 wherein said package is evacuated of air to promote said snug enclosing of said backing board and said imbedded comestible product and to enhance the shelf life of the packaged comestible.

5. The package of claim 1 wherein said backing board is formed from a transparent material to permit observation of the underside of the overlapping array of sliced comestible product.

6. The package of claim 1 wherein a portion of said film bears visual indicia.

7. The package of claim 1 wherein said backing board is formed from a sheet of a plastic material.

8. The package of claim 1 wherein the slab of which comestible product comprises sliced bacon.

* * * * *